United States Patent [19]

Otaka et al.

[11] Patent Number: 4,517,951

[45] Date of Patent: May 21, 1985

[54] INTAKE MANIFOLD APPARATUS IN MULTI-CYLINDER ENGINE

[75] Inventors: Shoichi Otaka, Oi; Yukio Kondo, Asaka; Masayuki Kumada, Tokyo; Hideyo Kawamoto, Kawagoe; Keiji Miura, Niiza, all of Japan

[73] Assignee: Honda Giken Kogyo Kabushiki Kaisha, Tokyo, Japan

[21] Appl. No.: 527,871

[22] Filed: Aug. 30, 1983

[30] Foreign Application Priority Data

Aug. 31, 1982 [JP] Japan ..... 57-150002
Nov. 22, 1982 [JP] Japan ..... 57-205131

[51] Int. Cl.[3] ..... F02M 25/06

[52] U.S. Cl. ..... 123/572; 123/573; 123/568

[58] Field of Search ..... 123/568, 572, 573, 52 M, 123/585

[56] References Cited

U.S. PATENT DOCUMENTS

| | | | |
|---|---|---|---|
| 3,123,060 | 3/1964 | Daigh | 123/572 |
| 3,441,008 | 4/1969 | Nelson | 123/52 |
| 3,500,806 | 3/1970 | Sarto | 123/572 |
| 3,802,402 | 4/1974 | Swatman | 123/568 |
| 3,846,980 | 11/1974 | Depalma | 123/573 |
| 3,872,845 | 3/1975 | Schultz | 123/568 |
| 3,949,719 | 4/1976 | Bellanca et al. | 123/119 B |
| 3,972,313 | 8/1976 | Marsee | 123/122 A |
| 4,094,283 | 6/1978 | Sutton | 123/568 |
| 4,261,316 | 4/1981 | Motosuzi | 123/568 |
| 4,269,607 | 5/1981 | Walker | 123/573 |

FOREIGN PATENT DOCUMENTS

| | | | |
|---|---|---|---|
| 2450977 | 12/1975 | Fed. Rep. of Germany | 123/568 |
| 191442 | 11/1982 | Japan | 123/568 |

*Primary Examiner*—Ronald H. Lazarus
*Attorney, Agent, or Firm*—Armstrong, Nikaido, Marmelstein & Kubovcik

[57] ABSTRACT

An intake manifold structure for a multi-cylinder engine having first and second independent mixture generators such as carburetors and first and second intake manifolds communicating the mixture generators to respective plural cylinders. A control gas passage and a treating gas passage are provided for introducing a control gas such as return flow exhaust gas, an additional pulse of air or the like, and a treating gas such as crankcase blow-by gas to the manifolds. The control gas passage is arranged to open into the interiors of respective diverging portions of the intake manifolds. The treating gas passage is arranged to open to the interiors of any other portions, avoiding the diverging portions, of the intake manifolds.

11 Claims, 5 Drawing Figures

INTAKE MANIFOLD APPARATUS IN MULTI-CYLINDER ENGINE

BACKGROUND OF THE INVENTION

This invention relates to an intake system of a multi-cylinder engine, and is more particularly directed to an intake manifold apparatus having first and second independent mixture gas generating means and first and second intake manifolds for communicating between these mixture gas generating means and respective plural cylinders of an engine body.

An apparatus has been known wherein a control gas for the mixture such as return flow exhaust gas, a pulse of air or the like and a treating gas such as a blow-by gas or the like are introduced into respective intake manifolds through a control gas passage and a treating gas passage, respectively. It is desirable for this type of apparatus to uniformly distribute the control gas for controlling the mixture to the respective cylinders, and to easily provide the two gas passages on the respective intake manifolds without being interrupted with each other.

OBJECT AND SUMMARY OF THE INVENTION

The present invention has as its object to provide an intake manifold apparatus which uniformly distributes the control gas for controlling the mixture to all of the cylinders and which is structured in a simple way.

The invention resides in an apparatus having first and second intake manifolds for communicating between these mixtures gas generating means and respective plural cylinders of an engine body. The intake manifolds are arranged such that a control gas for controlling the mixture gas such as a return flow exhaust gas, a pulse of air or the like may be introduced thereinto through a control gas passage and a treating gas such as a blow-by gas or the like may be introduced thereinto through a treating gas passage. The invention is characterized in that the control gas passage is arranged to be open to the interiors of respective diverging portions of the intake manifolds, and the treating gas passage is arranged to be open to the interiors of respective other portions, avoiding the diverging portions, of the intake manifolds.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
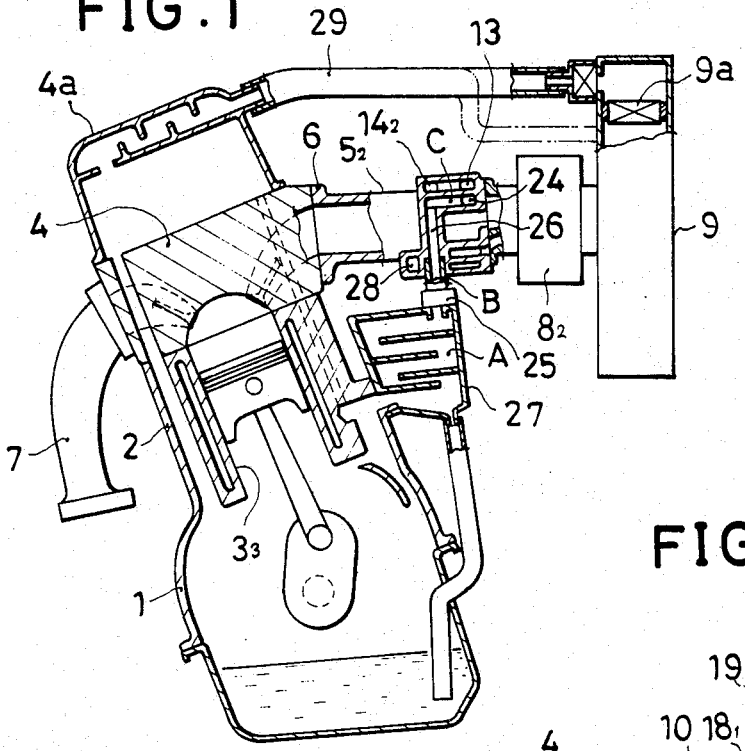
FIG. 1 is a sectional side view of one embodiment of this invention.
Figure 2:
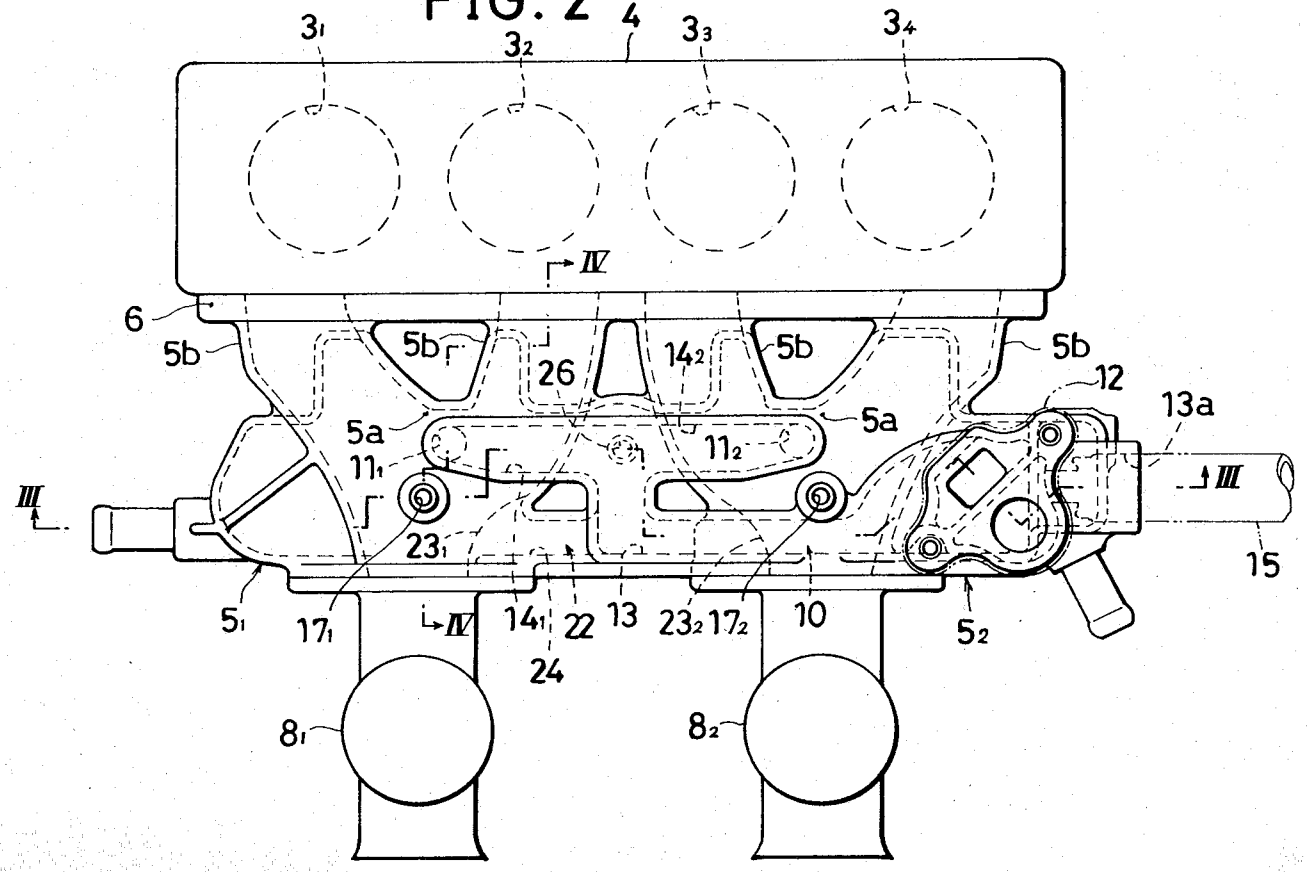
FIG. 2 is a top plan view of an important portion thereof.

One embodying example of this invention will be explained with reference to the accompanying drawings:

In the illustrated example wherein this invention is applied to a four-cylinder engine, a cylinder block 2 which is an upper portion of a crankcase 1 thereof is provided therein with first to fourth cylinders $3_1$, $3_2$, $3_3$, $3_4$ arranged in order from the left to the right as shown in FIG. 2. The cylinder head 4 which is an upper part thereof is provided on one side surface thereof with a pair of right and left first and second intake manifolds $5_1$, $5_2$ fixed thereto by means of bolts (not illustrated) through a single common attaching flange 6 interconnecting those manifolds $5_1$, $5_2$. As shown in FIG. 1, each cylinder head is provided on another side surface thereof with an exhaust manifold 7 jointed thereto.

Each of the intake manifolds $5_1$, $5_2$ is provided with a pair of distribution pipes $5_b$, $5_b$ bifurcated from an intermediate diverging portion $5_a$ thereof. The two distribution pipes $5_b$, $5_b$ of the first intake manifold $5_1$ are connected to the first and second cylinders $3_1$, $3_2$. The two distribution pipes $5_b$, $5_b$ of the second intake manifold $5_2$ are connected to the third and fourth cylinders $3_3$, $3_4$. First and second carburetors $8_1$, $8_2$ constituting the first and second mixture gas generating means independent one from another are connected to inlet openings of the respective intake manifolds $5_1$, $5_2$. As shown in FIG. 1, an air cleaner 9 is connected to upstream side portions of the two carburetors $8_1$, $8_2$.

Figure 4:
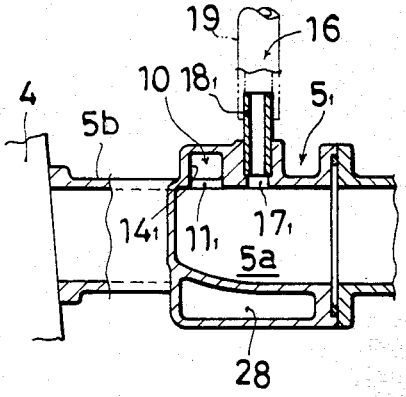
FIGS. 3 and 4 are sectional views taken along the line III—III and IV—IV in FIG. 2.
Figure 3:
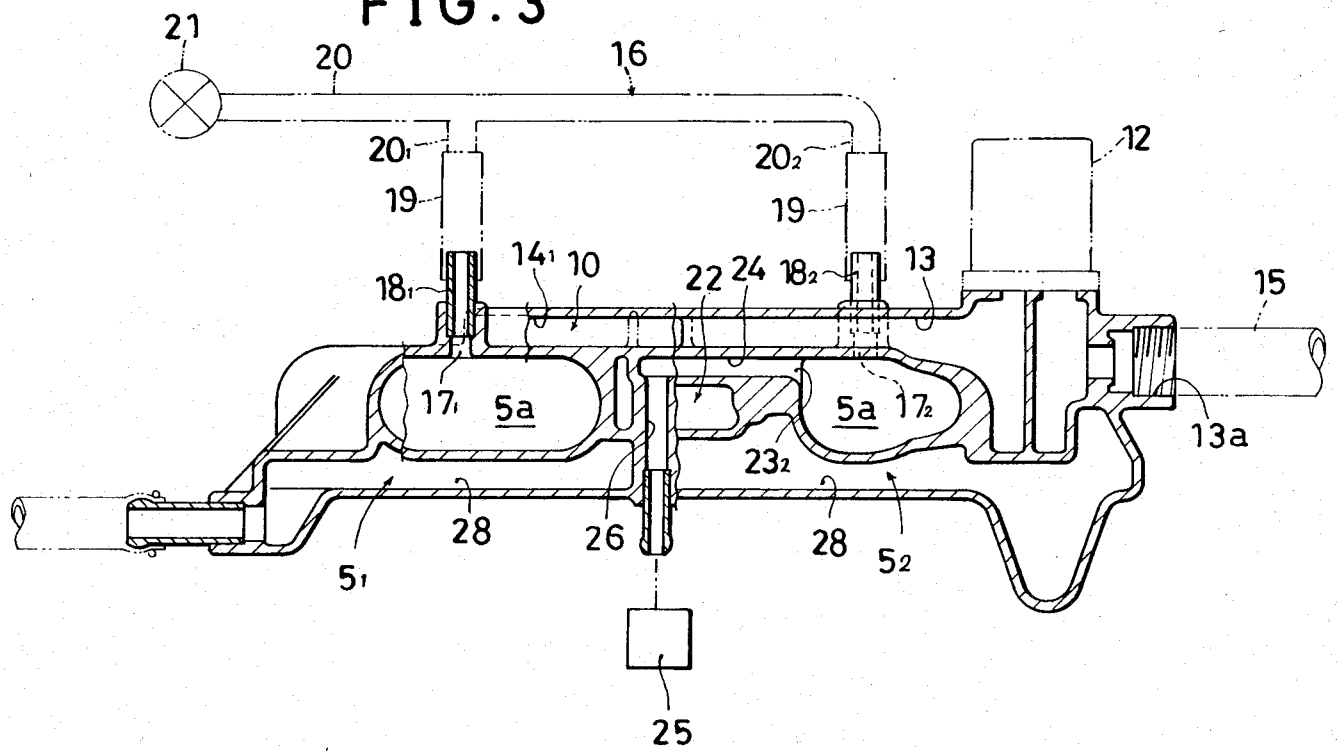

As shown in FIGS. 2 to 4, a return flow exhaust gas passage 10 constituting a first control gas passage is provided to open to the upper portions of the interiors of the diverging portions $5_a$, $5_a$ of the two intake manifolds $5_1$, $5_2$. Open portions thereof are denoted by reference numerals $11_1$, $11_2$. In the illustrated example, the return flow exhaust gas passage 10 comprises a main passage 13 having a flow rate control valve 12 interposed therein, and first and second diverged passages $14_1$, $14_2$ diverged from a downstream side of the flowing rate control valve 12 and open to the foregoing diverging portions $5_a$, $5_a$. The first and second diverged passage $14_1$, $14_2$ are formed to be equal in length one to another. A portion of the return flow exhaust gas passage 10 that extends from near the flowing rate control valve 12 to the downstream end portions of the first and second diverged passages $14_1$, $14_2$, that is, to the open portions $11_1$, $11_2$ is formed into an integral construction with the two intake manifolds $5_1$, $5_2$ by forming the same integral with the intake manifolds $5_1$, $5_2$ upon the casting thereof. The second intake manifold $5_2$ is provided at its outer end surface with an inlet opening 13*a* of the main passage 13. A conduit pipe 15 connected to a return flow exhaust gas discharging opening (not illustrated) made in the foregoing exhaust manifold 7 is connected to the inlet opening 13*a*.

Thus, the exhaust gas taken out from the return flow exhaust gas discharging opening is introduced into the main passage 13 through the conduit pipe 15. In this example, the same is controlled by the flow rate control valve 12 so that it has a flow rate corresponding to a particular engine operation condition. Thereafter the return flow exhaust gas is uniformly distributed into the first and second diverged passages $14_1$, $14_2$ of the same length for being supplied to the respective diverging portions $5_a$, $5_a$ of the first and second intake manifolds $5_1$, $5_2$. Accordingly, the return flow exhaust gas supplied to each diverging portion $5_a$ is uniformly distributed into the corresponding two distribution pipes $5_b$, $5_b$. Thus, the return flow exhaust gas is supplied to the first to fourth cylinders $3_1$–$3_4$ uniformly together with the mixture gas, and can serve to decrease the generation of $NO_x$ at the time of combustion of the mixture gas.

Additionally, an impulse air passage 16 constituting a second control gas passage is arranged to be open to upper portions of the interiors of the respective diverging portions $5_a$, $5_a$ of the first and second intake manifolds $5_1$, $5_2$. The open portions thereof are indicated by reference numerals $17_1$, $17_2$. The impulse air passage 16 comprises first and second introducing pipes $18_1$, $18_2$ jointed by casting to upper walls of the diverging portions $5_a$, $5_a$ and a metallic diverged pipe 20 having branch portions $20_1$, $20_2$ connected through respective flexible connecting pipes 19, 19 of rubber or the like to these introducing pipes $18_1$, $18_2$. The inlet opening of the pipe 20 is provided with an impulse air valve 21.

At the time of beginning of an engine deceleration operation wherein the mixture gas become temporarily rich, the impulse air valve 21 detects this rich condition to operate, and a predetermined amount of impulse air is uniformly distributed through the branch pipe 20 to the first and second introducing pipes $18_1$, $18_2$, and is supplied to the respective diverging portions $5_a$, $5_a$ of the first and second intake manifolds $5_1$, $5_2$. The air supplied in each diverging portion $5_a$ is distributed uniformly to the two distribution pipes $5_b$, $5_b$ so as to be mixed with the mixture gas flowing there-through so that the air-fuel ratio thereof may be properly compensated.

Additionally, a treating gas passage 22 is open to the interiors of any other portions, avoiding the diverging portions $5_a$, $5_a$, of the first and second intake manifolds $5_1$, $5_2$. The open portions thereof are denoted by reference numerals $23_1$, $23_2$. In the illustrated example, these open portions $23_1$, $23_2$ are disposed on mutually opposite side walls of the first and second intake manifolds $5_1$, $5_2$ and near the inlet openings of the manifolds $5_1$, $5_2$.

The treating gas passage 22 comprises a communication passage 24 formed integrally, by casting, with the two intake manifolds $5_1$, $5_2$ so as to communicate between the two opposite open portions $23_1$, $23_2$. An introducing passage 26 can extend from a middle portion of a bottom wall of the communication passage 24 downwards through an interval space between the two intake manifolds $5_1$, $5_2$ and connecting to a positive crankcase ventilation valve 25 (PCV valve). As shown in FIG. 1, the PCV valve 25 is in communication through a breather chamber 27 to the crankcase 1.

If a blow-by gas is generated in the crankcase 1 during engine operation, the gas is introduced into the communication passage 24 through the PCV valve 25 and the introducing passage 26. The flow thereof is divided from the middle portion thereof into two portions flowing to the right and the left to be introduced into the first and second intake manifolds $5_1$, $5_2$, respectively, and is conveyed along with the mixture gas to the corresponding cylinders $3_1$–$3_4$ so as to be treated by combustion.

When the treating gas is introduced into the intake manifolds $5_1$, $5_2$, even if the distributed amounts thereof into the two distribution pipes $5_b$, $5_b$ are not made equal one to another by the arrangement that the open portions $23_1$, $23_2$ of the treating gas passage 22 are provided at any other portions avoiding the diverging portions $5_a$, $5_a$, it does not disturb the balance in air-fuel ratio of the mixture gas supplied to the respective cylinders $3_1$–$3_4$, because in general the amount of such a treating gas (blow-by gas) is very small in comparison with the amount of the mixture gas supplied to each cylinder.

Additionally, the two intake manifolds $5_1$, $5_2$ are provided at a bottom wall thereof with respective hot water riser portions 28 for heating the mixture gas flowing through the intake manifolds $5_1$, $5_2$ by flowing therethrough cooling water heated by the engine. The treating gas passage 22 is arranged to be inserted, at the introducing passage 26 thereof, through the hot water riser portions 28 so that freezing of moisture contained in the blow-by gas in the treating gas passage 22 or in the PCV valve 25 may be effectively prevented by a heat transmission from the hot water riser portions 28.

Otherwise, freezing in the treating gas passage 22 or in the PCV valve 25 would result in an increase in internal pressure of the crankcase 1. The blow-by gas would then flow backwards to the air cleaner 9 through an external air introducing passage 29 connected to the cylinder head cover 4a as shown in FIG. 1. The filter element 9a of the air cleaner 9 would be contaminated with oil mist or the like contained in the blow-by gas. Also, if the passage 29 is connected to a clean side of air cleaner 9 as shown by dotted lines in FIG. 1, the respective carburetors $8_1$, $8_2$ connected thereto would be contaminated. Those inconveniences can be effectively eliminated by the foregoing preventive arrangement.

Figure 5:
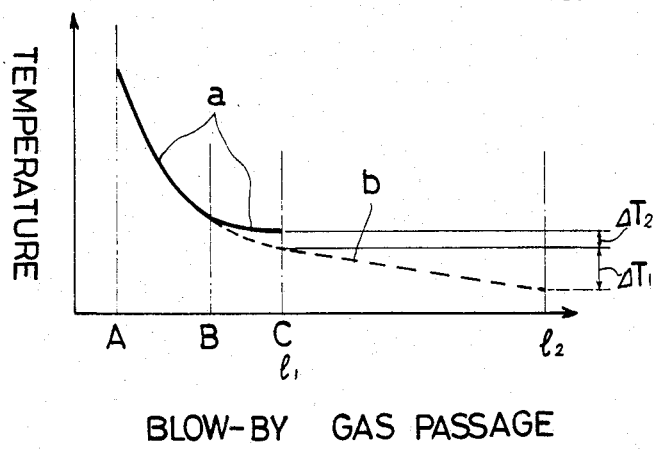
FIG. 5 is a diagram showing temperature lowering characteristics of a blow-by gas.

A curve a in FIG. 5 shows the temperature lowering characteristic of the blow-by gas in the treating gas passage 22 flowing from a point A on the breather chamber 27 side to a point C on the communication passage 24 side through a point B before it enters the hot water riser portion 28. When this is compared with the temperature lowering characteristic, shown by a curve b, which results from a conventional case wherein the treating gas passage extending from the breather chamber is connected to an upper portion of the intake manifolds through going roundabout the outside thereof, lowering in the temperature difference $\Delta T_1$ resultant from shortening the length of the treating gas passage from $l_1$ in this conventional case to $l_2$ in this invention case and a temperature difference $\Delta T_2$ resulted from heating at the hot water riser portion 28.

In the illustrated example, the communication passage 24 of the treating gas passage 22 and the return flow exhaust gas passage 10 are so disposed in upper and lower relationship as to be close one to another. In this manner, the treating gas passage 22 may be heated also by the exhaust gas and thereby the prevention of freezing of the moisture may be further ensured. Additionally, the respective open portion $23_1$, $23_2$ on the opposite ends of the communication passage 24 are positioned on the upper sides in the respective intake manifolds $5_1$, $5_2$ so that condensed liquid fuel may not be introduced into the treating gas passage 22.

In the foregoing example, the two diverged passage $14_1$, $14_2$ of the return flow exhaust gas passage 10 and the communication passage 24 of the treating gas passage 22 can function also as a balancing passage for balancing the pressures in the two intake manifolds $5_1$, $5_2$.

Thus, according to this invention, there are provided the first and second independent mixture gas generating means and first and second intake manifolds for communicating respectively between these mixture gas generating means and the respective plural cylinders of the engine body. The control gas passage for supplying a control gas for controlling the mixture gas such as a return flow exhaust gas, impulse air or the like is arranged to open to the interiors of the diverging portions of the intake manifolds. The treating gas passage for supplying a treating gas such as a blow-by gas or the like is arranged to open to the interiors of any other portions than the diverging portions, of the intake manifolds. Thus, the positioning of the respective open portions of the control gas passage and the treating gas passage to each of the intake manifolds near to another can be avoided. At the same time the two passages can be easily disposed without interfering with one another. Additionally, the control gas which affects the combustion condition of the mixture gas can be distributed uniformly to the plural distribution pipes as a result of being supplied to the respective diverging portions of the intake manifolds. The air-fuel ratio and other properties of the mixture gas supplied to each cylinder of the engine can be properly controlled and there can be always obtained a good combustion condition. On the other hand, the treating gas is supplied to the respective intake manifolds through any other positions than the diverging portions, so that the same tends to be supplied unequally to certain cylinders. However, owing to the fact that the amount thereof is generally very small, it does not give any bad influence on the proper combustion condition of the mixture at any of the cylinders.

It is readily apparent that the above-described intake manifold apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed:

1. In a plural cylinder internal combustion engine which includes a crankcase, a first and a second independent air-fuel gas generating means, first and second intake manifolds each including a first area to which a respective air-fuel gas generating means is mounted and a second area where divergent flow paths are provided, said divergent paths being downstream from the first area in the flow path of the air-fuel gas toward the engine, wherein the improvement comprises:

a source of control gas consisting of either engine exhaust or an auxiliary air supply at least one control gas passage for feeding said control gas from at least one source of said control gas to both said first and second intake manifolds at said second areas thereof, and a crankcase vapor passage connected from the crankcase to both said first and second intake manifolds at a location between said first and second areas thereof downstream from said first areas.

2. The apparatus of claim 1, wherein the control gas passage comprises a main passage, a flow rate control valve in the main passage for controlling the flow rate of the control gas interposed therein, and diverged passages diverged from the main passage downstream of the flow rate control valve and connected to the respective second areas, each diverged passage being substantially equal in length to the other.

3. The apparatus of claim 2, wherein at least a portion of the control gas passage which extends from the position of the flow rate control valve to the downstream ends of the diverged passages is constructed integral with the intake manifolds.

4. The apparatus of claim 1, wherein the control gas passage is made of a pipe material.

5. The apparatus of claim 1 wherein the vapor passage includes a communication passage open at its opposite end portions to the interiors of the intake manifolds.

6. The apparatus of claim 1 wherein the manifolds include a hot water riser portion provided on lower surfaces thereof and said vapor passage is inserted therethrough.

7. The apparatus of claim 6, wherein said vapor passage has a communication passage open at its opposite end portions to the interiors of the two intake manifolds, and an introducing passage extending downwards from the communication passage through an interval space formed between the two intake manifolds and is inserted through hot water riser portion.

8. The apparatus of claim 5, wherein the communication passage is provided near the control gas passage for a return flow exhaust gas.

9. The apparatus of claim 5, wherein both the end portions of the communication passages are arranged to open to upper portions of the interiors of the respective intake manifolds.

10. The apparatus of claim 7, wherein the communication passage is provided near the control gas passage for a return flow exhaust gas.

11. The apparatus of claim 9, wherein both the end portions of the communication passages are arranged to open to upper portions of the interiors of the respective intake manifolds.

* * * * *